US009920773B2

(12) United States Patent
Wilson et al.

(10) Patent No.: US 9,920,773 B2
(45) Date of Patent: Mar. 20, 2018

(54) THREADED CONNECTION HAVING DIFFERENT UPPER AND LOWER THREADS FOR SUBMERSIBLE WELL PUMP MODULES

(71) Applicant: Baker Hughes Incorporated, Houston, TX (US)

(72) Inventors: Brown Lyle Wilson, Tulsa, OK (US); Donn J. Brown, Broken Arrow, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 456 days.

(21) Appl. No.: 14/584,017

(22) Filed: Dec. 29, 2014

(65) Prior Publication Data

US 2015/0184675 A1 Jul. 2, 2015

Related U.S. Application Data

(60) Provisional application No. 61/921,251, filed on Dec. 27, 2013.

(51) Int. Cl.

| | |
|---|---|
| ***F04D 29/62*** | (2006.01) |
| ***F04D 29/60*** | (2006.01) |
| ***F04D 13/02*** | (2006.01) |
| ***F04D 13/10*** | (2006.01) |
| ***F04D 13/06*** | (2006.01) |
| ***F04D 13/08*** | (2006.01) |
| ***F04D 29/054*** | (2006.01) |

(52) U.S. Cl.

CPC ..... *F04D 29/628* (2013.01); *F04D 13/02* (2013.01); *F04D 13/021* (2013.01); *F04D 13/062* (2013.01); *F04D 13/086* (2013.01); *F04D 13/10* (2013.01); *F04D 29/054* (2013.01); *F04D 29/607* (2013.01)

(58) Field of Classification Search

CPC ..... Y10T 403/56; F04D 13/02; F04D 13/021; F04D 13/062; F04D 13/086; F04D 29/007; F04D 5/00; F04D 29/052; F04D 29/054; F04D 29/607

See application file for complete search history.

(56) References Cited

U.S. PATENT DOCUMENTS

| | | | |
|---|---|---|---|
| 2,233,890 | A | 3/1941 | Hoover |
| 3,390,371 | A | 6/1968 | Kramer |
| 4,060,345 | A | 11/1977 | Blum |

(Continued)

*Primary Examiner* — Bryan Lettman
*Assistant Examiner* — Timothy Solak
(74) *Attorney, Agent, or Firm* — Bracewell LLP; James E. Bradley

(57) ABSTRACT

An electrical submersible pump assembly has pump, motor and pressure equalizer modules. A first adapter, which secures to the first module, has an external set of first adapter threads. A second adapter, which secures to the second module, has an external set of second adapter threads. A collar has an internal set of collar first threads that engage the first adapter threads, and an internal set of collar second threads that engage the second adapter threads. The collar first and second threads differ from each other, such that rotation of the collar relative to the first and second modules pulls the first and second modules toward each other. The pitches of the collar first and second threads may differ. Or, the collar first and second threads may turn in opposite directions.

18 Claims, 3 Drawing Sheets

(56) References Cited

U.S. PATENT DOCUMENTS

| | | | | |
|---|---|---|---|---|
| 4,154,302 | A | 5/1979 | Cugini | |
| 4,582,131 | A * | 4/1986 | Plummer | E21B 37/06 166/310 |
| 4,627,490 | A | 12/1986 | Moore | |
| 4,708,201 | A | 11/1987 | Reed | |
| 4,728,296 | A | 3/1988 | Stamm | |
| 4,762,344 | A * | 8/1988 | Perkins | E21B 17/08 285/148.19 |
| 5,343,942 | A | 9/1994 | Serra et al. | |
| 5,380,158 | A | 1/1995 | Gerbitz | |
| 5,609,440 | A * | 3/1997 | Roche | F16L 15/007 285/330 |
| 6,557,905 | B2 | 5/2003 | Mack et al. | |
| 7,478,842 | B2 * | 1/2009 | Reynolds, Jr. | F16L 15/004 285/333 |
| 7,841,395 | B2 * | 11/2010 | Gay | E21B 43/128 166/105 |
| 8,029,026 | B2 * | 10/2011 | Stolle | E21B 17/0426 285/330 |
| 2003/0194331 | A1 * | 10/2003 | Pitla, Sr. | F04B 39/121 417/360 |
| 2009/0010773 | A1 * | 1/2009 | Parmeter | F04D 29/0413 417/410.1 |
| 2012/0032435 | A1 * | 2/2012 | Carcagno | E21B 17/0423 285/96 |
| 2013/0340245 | A1 | 12/2013 | Watson et al. | |

* cited by examiner

THREADED CONNECTION HAVING DIFFERENT UPPER AND LOWER THREADS FOR SUBMERSIBLE WELL PUMP MODULES

CROSS REFERENCE TO RELATED APPLICATION

This application claimes priority to provisional application 61/921,251, filed Dec. 27, 2013.

FIELD OF THE DISCLOSURE

This disclosure relates in general to submersible well pump assemblies and in particular to a threaded coupling between modules that has upper and lower sets of threads that differ from each other.

BACKGROUND

Submersible well pump assemblies (ESP) are commonly used to pump well fluid from oil wells. A typical ESP includes a pump and an electrical motor. The pump may be a centrifugal motor having a large number of stages, each stage comprising an impeller and a diffuser. Alternately, the pump may be another type, such as a progressing cavity pump. An ESP includes a pressure equalizer that couples to the motor to reduce a pressure difference between dielectric lubricant in the motor and the hydrostatic pressure of the well fluid. The ESP may include other components, such as a gas separator and additional motors and pumps in tandem. The various components are normally brought to a well site in separate modules, then secured together.

Generally the modules of the ESP are connected together by bolts that secure mating flanges. In some wells, a vertical section leads around a bend to an inclined or horizontal section. Inserting a lengthy ESP around the bend can cause stresses to the bolts.

It has been proposed instead of bolted flanges to employ threaded collars that are rotated to secure the various modules of the ESP. An example of a threaded collar arrangement is shown in U.S. Pat. No. 6,557,905. The threaded collar fits around a neck of an adapter of one of the modules and engages threads on the adapter of the other module.

SUMMARY

In this disclosure a submersible pump assembly has a plurality of modules including a pump, a motor, and a pressure equalizer for reducing a pressure differential between lubricant in the motor and hydrostatic pressure of well fluid. A first one of the modules has a first drive shaft rotatably mounted therein, the first drive shaft extending along a longitudinal axis and having a splined end. A second one of the modules has a second drive shaft rotatably mounted therein, the second drive shaft having a splined end. A first adapter is secured to the first one of the modules, the first adapter having a set of first adapter threads. A second adapter is secured to the second one of the modules, the second adapter having a set of second adapter threads. A collar has a set of collar first threads that engage the first adapter threads, and a set of collar second threads that engage the second adapter threads. The collar first and second threads differ from each other, such that rotation of the collar relative to the first and second modules in a single direction pulls the first and second modules toward each other and positions the splined ends of first and second drive shafts in full engagement with each other.

In one embodiment, the collar first threads and the collar second threads have different pitches. The collar first threads and the collar second threads may both turn in a same direction but have different pitches. For example, the pitch of the collar first threads may be twice the pitch of the collar second threads. An axial length of the collar first threads may be greater than an axial length of the collar second threads by at least an amount proportional to the difference in pitch.

In another embodiment, the collar first threads turn in an opposite direction to the collar second threads. In that embodiment, the collar first threads may have an axial length greater than the collar second threads.

Mating load shoulders on the first and second adapters engage each other when the collar is fully made up. Mating anti-rotation members on the first and second adapters, which may be part of the load shoulders, engage each other when the collar is fully made up to prevent rotation of the first and second adapters relative to each other after full make up.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
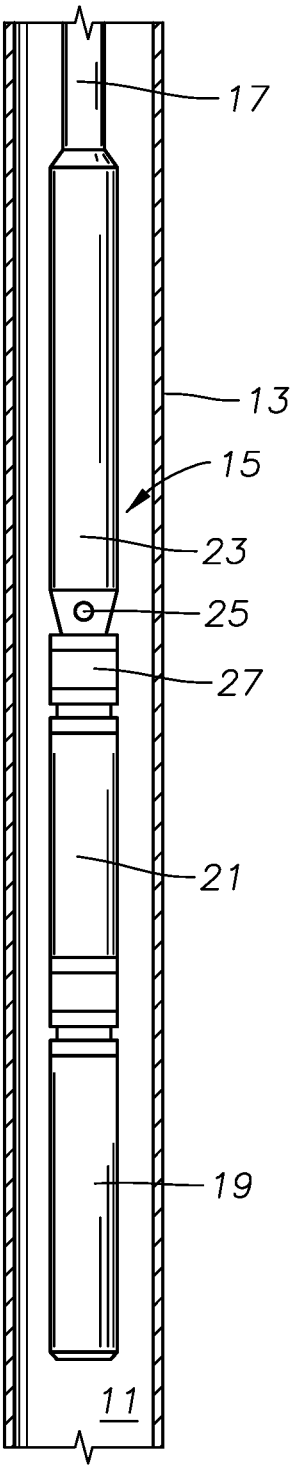
FIG. 1 is a side view of an electrical submersible pump assembly in accordance with this disclosure and installed in a well.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well 11 has casing 13 that is perforated or has other openings to admit well fluid. A pump assembly 15 is illustrated as being supported on production tubing 17 extending into well 11. Alternately, pump assembly 15 could be supported by other structure, such as coiled tubing. Although shown installed vertically, pump assembly 15 could be located within an inclined or horizontal section of well 11. Pump assembly 15 has several modules, including a motor 19, normally a three-phase electrical motor. A pressure equalizer or seal section 21 connects to the upper end of motor 19 and has components, such as a bladder or bellows, for reducing a pressure differential between lubricant in motor 19 and the hydrostatic pressure of well fluid. Alternately, seal section 21 could connect to a lower end of motor 19.

A pump 23 having an intake 25 connects to seal section 21. Pump 23 is normally a rotary pump, such as a centrifugal or progressing cavity pump. However, pump 23 could be a reciprocating pump. An optional gas separator could be connected between pump 23 and seal section 21. In addition to a gas separator, motor 19 could be connected in tandem to another motor, and pump 23 could be connected in tandem to another pump, adding additional modules to pump assembly 15.

Submersible well pump assemblies usually have bolted flange connections between the modules. In wells having an inclined section, during installation, the well pump assembly may be pushed through a bend between the vertical and inclined sections. The sharper the bend, the more stress is put on the joints of the pump assembly. High stress can cause the bolts to stretch, causing premature system failure.

Figure 2:
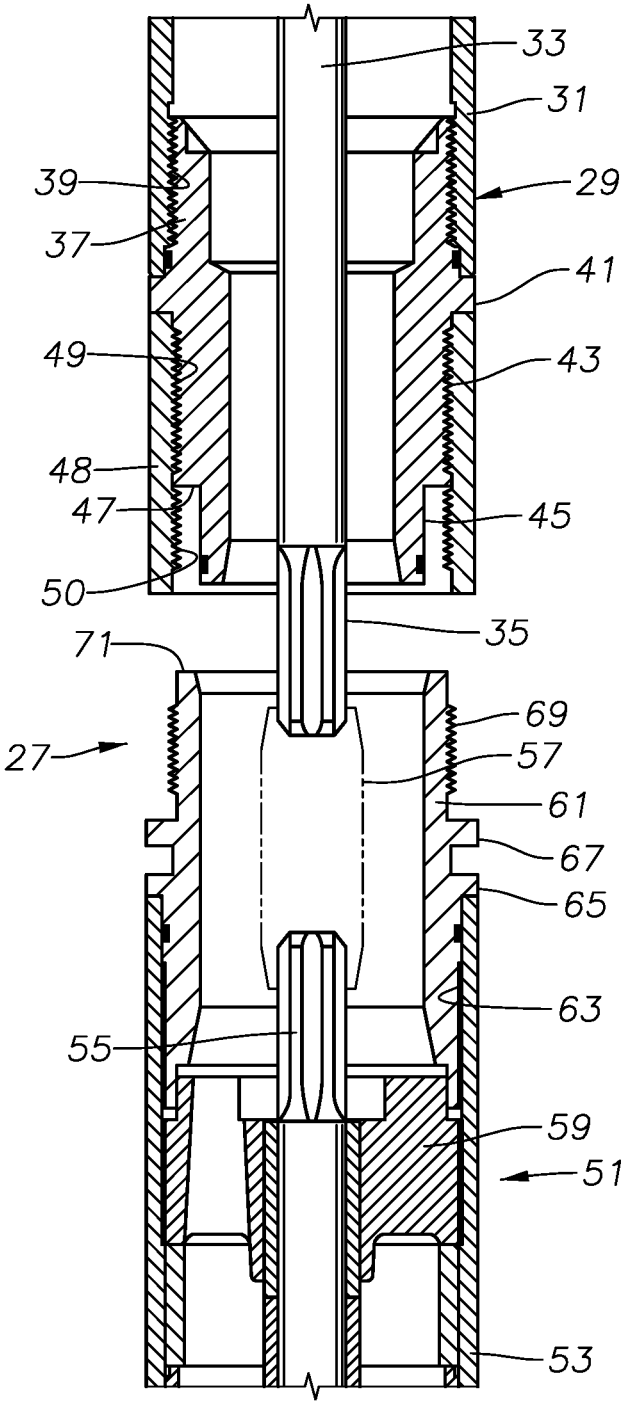
FIG. 2 is a sectional view of a first embodiment of one of the threaded connections between modules of the pump assembly of FIG. 1.

In this disclosure, at least one or all of the connections or between the modules of pump assembly 15 comprises a threaded connection 27. Referring to the first embodiment of FIGS. 2-4, a first or upper module 29 may be any one of the modules of the pump assembly 15, such as seal section 21, pump 27, an upper tandem motor (not shown), a gas separator (not shown) or an upper tandem pump (not shown). The terms "upper", "lower" and the like are used only for convenience as pump assembly 15 may be operating while in a horizontal position. Also threaded connection 27 could be inverted from the position shown during operation.

Upper module 29 has a cylindrical housing 31 with a rotatable drive shaft 33 extending concentrically within housing 31. Radial bearings (not shown) may be employed to center and maintain drive shaft 33 on a longitudinal axis of housing 31. Shaft 33 has a splined lower end 35. An upper adapter 37 inserts into the lower end of housing 31 and is secured by housing internal threads 39 in housing 31. Upper adapter 37 has a circumferential external band or stop 41 that abuts the lower end of housing 31. Upper adapter 37 has a set of external threads 43 and a cylindrical nose section 45 extending downward from external threads 43. Nose section 45 has a smaller outer diameter than external threads 43, defining a downward-facing torque shoulder 47.

A cylindrical sleeve or collar 48 has a set of upper internal threads 49 that mate with upper adapter external threads 43. Collar 48 has a set of lower internal threads 50 located below and spaced axially from upper internal threads 49. Upper internal threads 49 have a pitch that differs from lower internal threads 50. In this embodiment, the pitch of upper internal threads 49 is smaller than the pitch of lower internal threads 50. In one example, the pitch of lower internal threads 50 is twice that of upper internal threads 49. The axial length of upper internal threads 49 is proportionately greater than the axial length of the lower internal threads 50. With a pitch one-half that of lower internal threads 50, preferably, the axial dimension or length of upper internal threads 49 is at least twice that of lower internal threads 50. In this embodiment, both threads 49, 50 turn in the same direction; that is both are either right-hand or left-hand threads.

A second or lower module 51 also may be any one of the modules of the pump assembly 15. Lower module 51 has a cylindrical housing 53 and a rotatable drive shaft 55 concentrically mounted within. Drive shaft 55 has a splined upper end that rotationally connects to upper drive shaft lower end 35 by a splined coupling 57. Coupling 57 is shown schematically and has internal splines as well as an optional internal compression spring. Radial bearings 59 (only one shown) in housing 53 axially support drive shaft 55

A second or lower adapter 61 secures to housing threads 63 and extends upward from lower housing 53. Lower adapter 61 may have two external circumferential bands 65, 67 spaced axially apart from each other. One band 65, 67, rather than two, would also be feasible. Band 65 abuts the upper end of lower housing 53. Lower adapter 61 has a set of external threads 69 that mate with lower internal threads 50 of collar 48. Lower adapter external threads 69 have the same pitch as lower internal threads 50. Lower adapter 61 has a rim 71, which serves as a torque load shoulder, on its upper end for engaging torque shoulder 47. Optionally, torque shoulder 47 and rim 71 could have mating friction or anti-rotation enhancements, such as teeth or knurling formed on them to resist rotation relative to each other. Further, other types of anti-rotation elements may be used to prevent rotation of lower adapter 61 relative to upper adapter 37.

Figure 3:
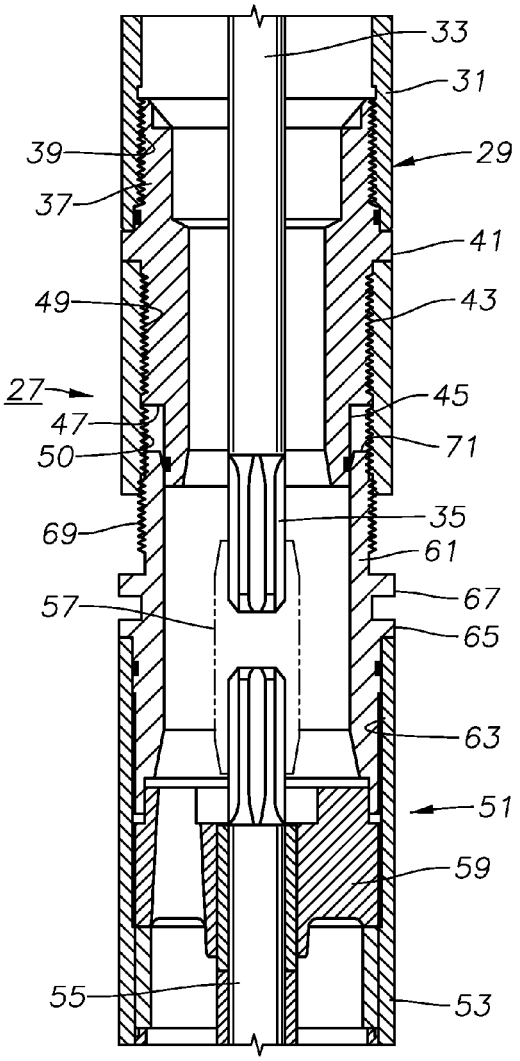
FIG. 3 is a sectional view of the threaded connection of FIG. 2, showing the modules stabbed into each other, but the collar not yet made up.

To connect upper module 29 with lower module 51, a worker rotates collar 48 to its highest point on upper adapter 37, which is an initial engagement position. The upper end of collar 48 will contact the lower side of band 41. The lower end of collar 48 may be located slightly below nose section 45 during the initial engagement position. The worker aligns upper shaft 33 with coupling 57 and moves upper module 29 toward lower module 51. Nose section 45 stabs partially into the bore of lower adapter 61, as shown in FIG. 3. Collar lower threads 50 will contact lower adapter external threads 69. The splined ends of shafts 33, 55 will be partially located within coupling 57 during this initial engagement position.

Figure 4:
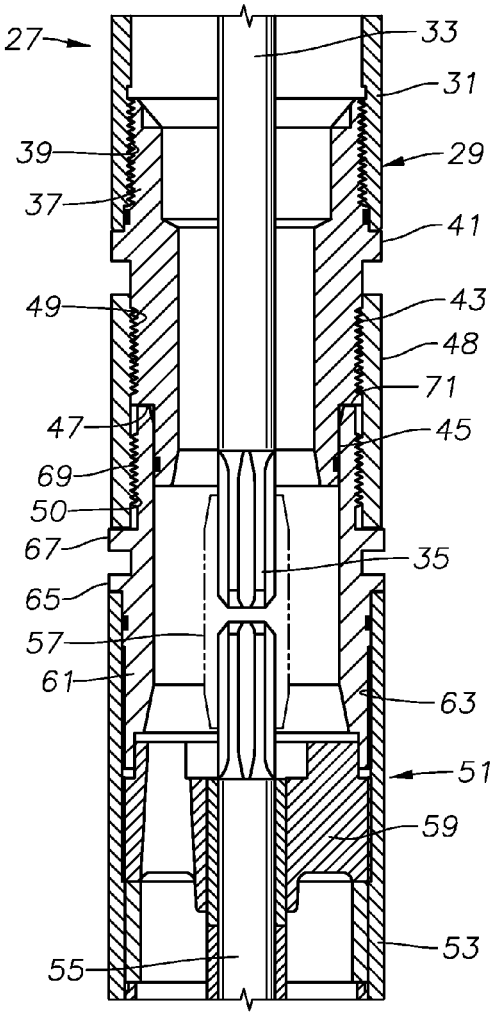
FIG. 4 is a sectional view of the threaded connection of FIG. 2 when made up.

The worker then begins rotating collar 48 in a single direction while restraining upper and lower adapters 37, 61 against rotation. The different pitch between collar upper threads 49 and collar lower threads 50 causes relative axial motion between upper adapter 37 and lower adapter 61, pulling them toward each other. Relative axial movement between collar 48 and lower adapter 61 while collar 48 is rotating is twice that of the relative axial motion between collar 48 and upper adapter 37. Lower adapter 61 and upper adapter 37 continue movement toward each other until rim 71 abuts torque shoulder 47, as shown in FIG. 4. The worker applies a specified torque to tighten the engagement of rim 71 and torque shoulder 47. The splined ends of shafts 33, 55 will be fully inserted into coupling 57.

Preferably, a slight clearance will exist between lower adapter band 67 and the lower end of collar 48 when collar 48 is tightened to a desired torque. A larger clearance will exist between the upper end of collar 48 and upper adapter band 41 in the full engagement position. Preferably, the upper end of upper adapter external threads 43 is spaced below upper adapter band 41 a sufficient distance such that at full make-up, no portion of upper adapter external threads 43 is exposed to the exterior. That is, the upper end of collar 48 will be closer to upper adapter band 41 at full make-up than the distance from upper adapter external threads 43 to upper adapter band 41. The lower end of collar 48 at full make-up will be below the lower end of lower adapter external threads 69. Nose section 45 will be in sealing engagement with the bore of lower adapter 61.

Figure 5:
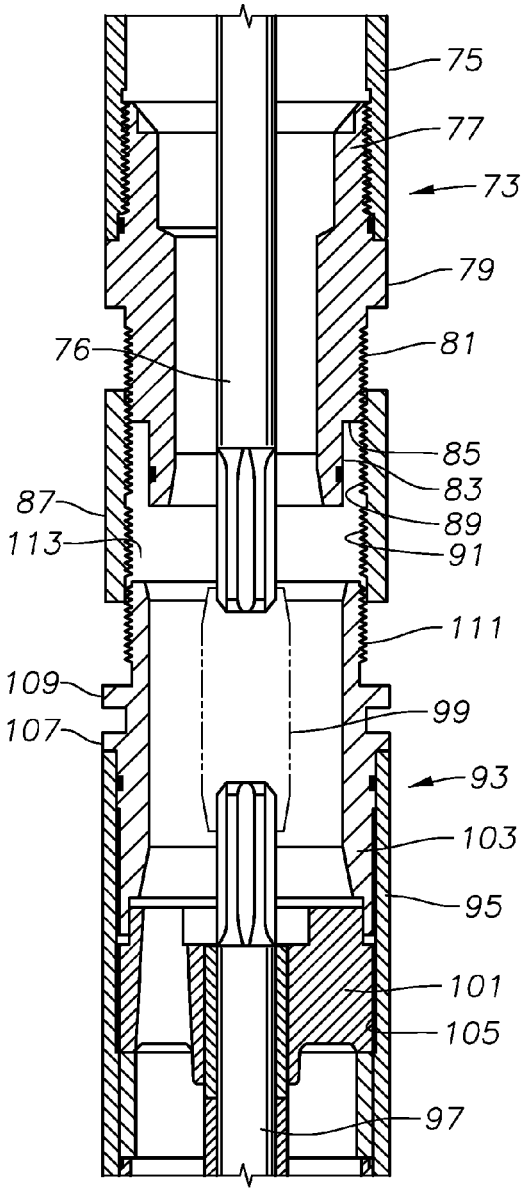
FIG. 5 is a sectional view of a second embodiment of one of the threaded connections, showing the modules stabbed into each other, but the collar not yet made up.
Figure 6:
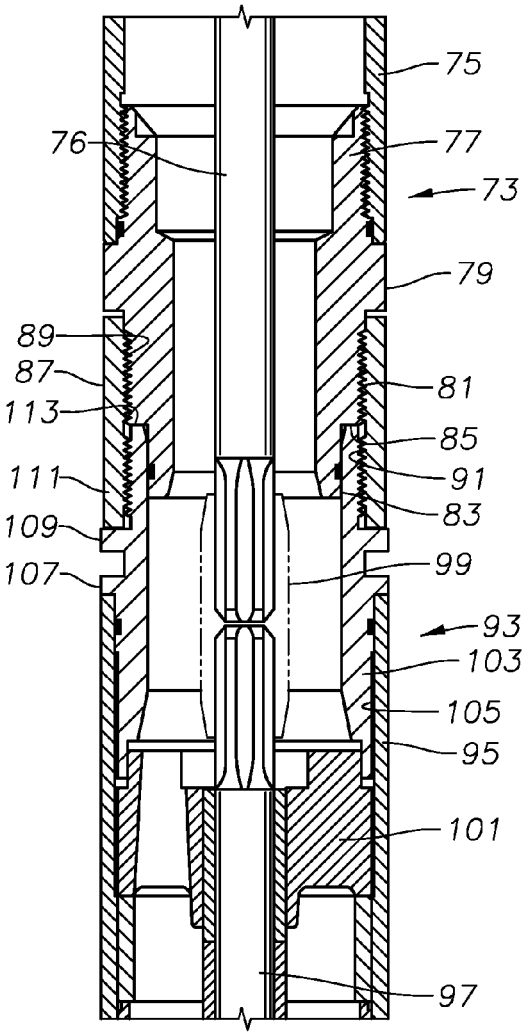
FIG. 6 is a sectional view of the threaded connection of FIG. 5 when made up.

Referring to the second embodiment in FIGS. 5 and 6, upper module 73 has a tubular housing 75 with a drive shaft 76 mounted concentrically therein. An upper adapter 77 secures by threads to housing 75. Upper adapter 77 has an external circumferential band or stop 79 that abuts a lower end of housing 75. Upper adapter 77 has external threads 81 and a nose section 83. A torque shoulder 85 is located at the upper end of nose section 83.

A collar 87 has a set of upper internal threads 89 that mate with upper adapter threads 81. Collar 87 has a set of lower internal threads 91 spaced a short distance below upper internal threads 89. Upper internal threads 89 and lower internal threads 91 have the same pitch, but turn in opposite directions; that is, one of the sets of threads 89, 91 is right-hand and the other left-hand. Upper internal threads 89 have a longer length or axial dimension than lower internal threads 91. Also, the length of upper internal threads 89 may be somewhat longer than the length of mating upper adapter external threads 81.

Lower module 93 has a housing 95 with a drive shaft 97. Drive shaft 97 and drive shaft 76 couple to each other for torque transmission via a splined coupling 99, which optionally has an internal compression spring. Lower module 93 has one or more radial bearings 101 to support drive shaft 97. A lower adapter 103 secures by housing threads 105 to housing 95 and extends upward. Lower adapter 103 has one or more circumferential bands 107, 109. Band 107 abuts an upper end of housing 95. Lower adapter 103 has a single set of external threads 111 that are turned opposite to upper adapter threads 81 and mate with collar lower threads 91. Lower adapter 103 has a rim 113.

To secure upper module 73 to lower module 93, a worker first rotates collar 87 down to a designated position with the upper end of collar 87 a selected distance below band 79, as shown in FIG. 5. A mark or other indicia may be placed on upper adapter threads 81 to indicate the desired initial engagement position to position collar 87 prior to stabbing collar 87 onto lower adapter 103. At this position, the disengaged portion of collar upper threads 89 will have a length slightly less than the axial distance from the upper end of collar 87 to the lower side of upper adapter band 79. The worker aligns and lowers upper module 73, causing upper drive shaft 76 to stab into partial engagement with splined coupling 99. The lower end of lower threads 91 in collar 87 will land on the upper end of lower adapter threads 111, as shown in FIG. 5. In this initial engagement position, the distance from the lower end of collar 87 to lower adapter band 109 will be the same as the distance from the upper end of collar 87 to the lower side of upper adapter band 79.

The worker rotates collar 87 in a single direction while preventing rotation of upper and lower adapters 79, 103. The opposite direction of threads 81 and 111 causes modules 73, 93 to move toward each other. As shown in FIG. 6, after rim 113 contacts torque shoulder 85, the worker applies a desired make-up torque. After the torque has been applied, a slight clearance will exist between the upper end of collar 87 and upper adapter band 79. A similar slight clearance will exist between the lower end of collar 87 and lower adapter band 109.

While the disclosure has been shown in only two of its forms, it should be apparent to those skilled in the art that it is susceptible to various changes.

The invention claimed is:

1. A submersible pump assembly, comprising:

a plurality of modules including a pump, a motor, and a pressure equalizer for reducing a pressure differential between lubricant in the motor and hydrostatic pressure of well fluid;

a first one of the modules having a first drive shaft rotatably mounted therein, the first drive shaft extending along a longitudinal axis and having a splined end;

a second one of the modules having a second drive shaft rotatably mounted therein, the second drive shaft having a splined end;

a coupling that receives the splined ends of the drive shafts to rotatably couple the drive shafts to each other;

a first adapter secured to the first one of the modules, the first adapter having a set of first adapter threads and a first adapter load shoulder;

a second adapter secured to the second one of the modules, the second adapter having a set of second adapter threads and a second adapter load shoulder;

a collar having a set of collar first threads that engage the first adapter threads, and a set of collar second threads that engage the second adapter threads, the collar surrounding the first and second adapter load shoulders; wherein the collar first and second threads differ from each other, such that rotation of the collar relative to the first and second modules in a single direction pulls the first and second modules toward each other, positions the splined ends of first and second drive shafts in full engagement with each other with the coupling, and causes the first and second adapter load shoulders to abut each other;

a nose section integrally formed with the first adapter and extending axially from an inner diameter of the first adapter load shoulder toward the second adapter, the nose section having a smaller outer diameter than an inner diameter of the second adapter;

a seal on the nose section; and wherein while in the full engagement, the nose section will be inserted into the inner diameter of the second adapter; and the seal will sealingly engage the inner diameter of the second adapter.

2. The assembly according to claim 1, wherein:

the collar first threads and the collar second threads have different pitches.

3. The assembly according to claim 1, wherein:

the collar first threads and the collar second threads both turn in a same direction but have different pitches.

4. The assembly according to claim 1, wherein:

the collar first threads and the collar second threads turn in a same direction; and a pitch of the collar first threads is twice a pitch of the collar second threads.

5. The assembly according to claim 1, wherein:

the collar first threads and the collar second threads turn in a same direction;

a pitch of the collar first threads is greater than a pitch of the collar second threads; and an axial length of the collar first threads is greater than an axial length of the collar second threads by at least an amount proportional to the difference in pitch.

6. The assembly according to claim 1, wherein:

the collar first threads turn in an opposite direction to the collar second threads.

7. The assembly according to claim 1, wherein:

the collar first threads turn in an opposite direction to the collar second threads; and the collar first threads have an axial length greater than the collar second threads.

8. An electrical submersible pump assembly, comprising:

a plurality of modules including a pump, a motor, and a pressure equalizer for reducing a pressure differential between lubricant in the motor and hydrostatic pressure of well fluid;

a first one of the modules having a first drive shaft rotatably mounted therein, the first drive shaft extending along a longitudinal axis and having a splined end;

a second one of the modules having a second drive shaft rotatably mounted therein, the second drive shaft having a splined end;

a coupling that receives the splined ends of the drive shafts to rotatably couple the drive shafts to each other;

a first adapter secured to the first one of the modules, the first adapter having an external set of first adapter threads;

a second adapter secured to the second one of the modules, the second adapter having an external set of second adapter threads;

mating first and second load shoulders on the first and second adapters, respectively;

a collar having an internal set of collar first threads that engage the first adapter threads, and an internal set of collar second threads that engage the second adapter threads; wherein the first and second adapters are dimensioned such that the mating load shoulders are axially spaced apart from each other and the coupling is only partially engaging the splined ends when the second adapter threads and the collar second threads are in an initial engagement position with each other;

the collar first and second threads differ from each other, such that rotation of the collar relative to the first and second modules from the initial engagement position to a full engagement position pulls the first and second modules toward each other until the load shoulders abut each other and the splined ends of first and second drive shafts fully engage the coupling;

while in the full engagement position, the collar surrounds the first and second load shoulders:

a cylindrical nose section extending from an inner diameter of the first load shoulder toward the second adapter, the nose section having an outer diameter smaller than an inner diameter of a bore of the second adapter;

a seal extending around the nose section;

wherein the second load shoulder is located on a rim of the second adapter; and while in the full engagement position, the nose section will be located in the bore of the second adapter and the seal in sealing engagement with a side wall of the bore of the second adapter.

9. The assembly according to claim 8, further comprising:

a stop on an exterior of the first adapter;

the collar having a first end that abuts the stop while in the initial engagement position; and wherein the first end of the collar is axially spaced from the stop when in the full engagement position.

10. The assembly according to claim 8 further comprising:

a stop on an exterior of the first adapter;

the collar having a first end that abuts the stop while in the initial engagement position; wherein the first end of the collar is axially spaced from the stop when in the full engagement position; and the first adapter threads have a first end axially spaced from the stop a distance selected such that the first end of the collar is closer to the stop than the distance from the first end of the first adapter threads to the stop when the collar is in the full engagement position.

11. The assembly according to claim 8, wherein:

the collar first threads and the collar second threads have different pitches.

12. The assembly according to claim 8, wherein:

the collar first threads turn in an opposite direction to the collar second threads.

13. An electrical submersible pump assembly, comprising:

a plurality of modules including a pump, a motor, and a seal section between the pump and the motor for reducing a pressure differential between lubricant in the motor and hydrostatic pressure of well fluid;

a first adapter secured to the first one of the modules, the first adapter having an external set of first adapter threads, a nose section of smaller outer diameter than the first external threads and extending from the first external threads, and a torque shoulder at a junction between the nose section and the first adapter threads;

a second adapter secured to the second one of the modules, the second adapter having an external set of second adapter threads and a rim;

the first one of the modules having a first drive shaft rotatably mounted therein, the first drive shaft extending along a longitudinal axis and having a splined end;

the second one of the modules having a second drive shaft rotatably mounted therein, the second drive shaft having a splined end;

a coupling that receives the splined ends of the drive shafts to rotatably couple the drive shafts to each other;

a collar having an internal set of collar first threads that engage the first adapter threads, and an internal set of collar second threads that engage the second adapter threads; wherein the collar first and second threads differ from each other, such that rotation of the collar in a single direction relative to the first and second modules pulls the first and second modules toward each other; and when the collar is in the full engagement position, the rim will be in abutment with the torque shoulder, the nose section of the first adapter will be in engagement with an inner diameter of the second adapter, and the coupling will be engaging the splined ends of the first and second drive shaft with each other.

14. The pump assembly according to claim 13, wherein the first adapter threads and the second adapter threads have different pitches.

15. The assembly according to claim 13, wherein one of the first adapter threads and the second adapter threads is right-hand, and the other is left hand.

16. The assembly according to claim 13, wherein:

one of the collar first and second threads is right-hand, and the other is left hand; and an axial length of the collar first threads is greater than an axial length of the collar second threads.

17. The assembly according to claim 13, further comprising:

an external stop on an exterior of the first adapter axially spaced from the first adapter threads; and wherein the collar has an initial engagement position with a first end of the collar in abutment with the stop; and while in the full engagement position, the first end of the collar is axially spaced from the stop.

18. A submersible pump assembly, comprising:

a plurality of modules including a pump, a motor, and a pressure equalizer for reducing a pressure differential between lubricant in the motor and hydrostatic pressure of well fluid;

a first one of the modules having a first drive shaft rotatably mounted therein, the first drive shaft extending along a longitudinal axis and having a splined end;

a second one of the modules having a second drive shaft rotatably mounted therein, the second drive shaft having a splined end;

a coupling that receives the splined ends of the drive shafts to rotatably couple the drive shafts to each other;

a first adapter secured to the first one of the modules, the first adapter having a set of first adapter threads and a first adapter load shoulder;

a second adapter secured to the second one of the modules, the second adapter having a set of second adapter threads and a second adapter load shoulder;

a collar having a set of collar first threads that engage the first adapter threads, and a set of collar second threads that engage the second adapter threads, the collar surrounding the first and second adapter load shoulders; wherein the collar first and second threads differ from each other, such that rotation of the collar relative to the first and second modules in a single direction pulls the first and second modules toward each other, positions the splined ends of first and second drive shafts in full engagement with each other with the coupling, and causes the first and second adapter load shoulders to abut each other; and mating anti-rotation members on the first adapter load shoulder and the second adapter load shoulder that engage each other when the collar is fully made up to prevent rotation of the first and second adapters relative to each other after full make up.

* * * * *